US005660127A

United States Patent [19]

Yamashita et al.

[11] Patent Number: 5,660,127

[45] Date of Patent: Aug. 26, 1997

[54] THREAD END CUTTING AND HOLDING IN A SEWING MACHINE

[75] Inventors: Takashi Yamashita; Mitsuo Watanabe, both of Tokyo, Japan

[73] Assignee: Juki Corporation, Tokyo, Japan

[21] Appl. No.: 496,094

[22] Filed: Jun. 28, 1995

[30] Foreign Application Priority Data

Jun. 29, 1994 [JP] Japan ..... 6-148165

[51] Int. Cl.[6] ..... B05B 65/00; B05B 63/00

[52] U.S. Cl. ..... 112/253; 112/292

[58] Field of Search ..... 112/291, 292, 112/298, 295, 229, 253

[56] References Cited

U.S. PATENT DOCUMENTS

| | | | |
|---|---|---|---|
| 757,463 | 4/1904 | Hogan | 112/253 X |
| 1,787,928 | 1/1931 | Carlson | 112/253 |
| 3,173,392 | 3/1965 | Hedegaard | 112/252 |
| 3,625,169 | 12/1971 | Yamashita | 112/168 |
| 4,589,362 | 5/1986 | Düsch | 112/292 |
| 5,005,504 | 4/1991 | Alblrecht et al. | 112/292 |
| 5,131,340 | 7/1992 | Tajima et al. | 112/298 X |

FOREIGN PATENT DOCUMENTS 99353 2/1933 Japan .

*Primary Examiner*—Ismael Izaguirre

*Attorney, Agent, or Firm*—Morgan, Lewis and Bockius LLP

[57] ABSTRACT

A bobbin thread end holding device in a sewing machine in which an upper thread and a bobbin thread are used holds an end portion of the bobbin thread after cut. The bobbin thread end holding device has a cutter for cutting the upper thread and the bobbin thread, and a bobbin thread control member. The bobbin thread control member includes: a thread control hole into which the upper thread and the bobbin thread are led; and a prolongation extending from the control hole, for outwardly introducing the end portion of the bobbin thread cut by the cutter from the control hole.

14 Claims, 13 Drawing Sheets

THREAD END CUTTING AND HOLDING IN A SEWING MACHINE

BACKGROUND OF THE INVENTION

1. Field of the Invention

This invention relates to a bobbin thread end holding device in a sewing machine, and more particularly to a bobbin thread end holding device in a sewing machine which employs a so-called DP type half-turn shuttle hook, and which does not use the thread hole of the engaging member of a bobbin casing, or uses a bobbin casing whose engaging member has no thread hole.

2. Related Art

A full-turn shuttle hook and a half-turn shuttle hook are available as shuttle hook bodies in sewing machines. An example of the half-turn shuttle hook is such that the needle comes between an upper thread loop and the bobbin; more specifically, the needle drop position is between the bobbin thread lead-out point of the bobbin and the sharp protrusion of the shuttle hook body (hereinafter referred to as "a DBS shuttle hook", when applicable). Another example of the half-turn shuttle hook is such that the upper thread loop comes between the needle and the bobbin; more specifically, the sharp protrusion of the shuttle hook body is between the needle drop position and the bobbin thread lead-out point of the bobbin (hereinafter referred to as "a DPS shuttle hook", when applicable).

A sewing machine having the DBS shuttle hook forms perfect stitches in a forward feeding operation (in which a fabric is fed in a right-to-left direction as viewed from the operator), and forms hitch stitches in a reverse feeding operation (in which a fabric is fed in a left-to-right direction as viewed from the operator). Hence, the sewing machine of this type is extensively employed for a lock stitching operation.

In general, in a lock stitching operation, perfect stitching should be employed to form straight stitches from the view point of the quality of stitches, and in order to eliminate the difficulty that a thread gets loose at both ends of a line of stitches, the latter should be ended by hitch stitching. In order to meet those requirements, the DBS shuttle hook is employed.

However, a sewing machine having the DBS shuttle hook is not suitable for an omnidirectional stitching operation.

A sewing machine having the DPS shuttle hook is also known in the art, see Japan Patent No. 99353 for instance. The sewing machine is able to form perfect stitches both in the forward feeding operation and in the reverse feeding operation, thus being suitable for an omnidirectional stitching operation; however, it is not popularly employed in the art yet.

However, it should be noted that the DPS shuttle hook responds well to the variation in thickness of a fabric, thus being suitable for sewing a heavy weight fabric and for use of a thread large in yarn number count.

FIG. 12 shows a conventional bobbin casing 100 used with an ordinary half-turn shuttle hook. As shown in FIG. 12, the bobbin casing 100 has an engaging member 101, in which a thread hole 102 is formed.

A bobbin thread 104 supplied from a bobbin 103 accommodated in the bobbin casing 100 is passed through the thread hole 102 of the engaging member 101 of the bobbin case 100.

The bobbin case is set in the sewing machine in such a manner that it faces forward so that it is convenient for the operator to handle when it is set in the sewing machine or removed from the latter.

The direction of rotation of the shuttle hook body should be so determined that the upper thread on the needle side is twistable because a sewing thread for a sewing machine is fundamentally of Z-twist. That is, in the case of the DBS shuttle hook, the direction of rotation of the shuttle hook body is clockwise as viewed from the operator side; and in the case of the DPS shuttle hook, the direction of rotation of the shuttle hook body is counterclockwise.

FIG. 13 shows the fundamental configuration of a thread control hole in a sewing machine employing the DBS shuttle hook. A thread control board, namely, a shuttle hook race cap 105 has the thread control hole 106.

As shown in FIG. 14, a bobbin thread 104, a cloth-side upper thread 114C, and a needle-side upper thread 114N are positioned in the thread control hole 106. A movable knife 107 having a supporting shaft 108 on the right side of the needle drop point O as viewed from the operator is held in front of the thread control hole. In a thread displacing operation (described later), the movable knife operates to displace the bobbin thread 104 and the upper thread in the stated order.

In a thread cutting device, as shown in FIG. 14 the bobbin thread 104 and the cloth-side upper thread 114C which are determined to be cut by the construction of the DBS shuttle hook are substantially in alignment with the needle drop point O, so that the amounts of displacement of the bobbin thread 104 and the cloth-side upper thread 114C which are due to the forward movement of the movable knife 107 are minimized.

The threads are cut as follows: The movable knife 107 is moved forwardly to start a thread displacing operation (in which, before cut, the bobbin thread 104 and the cloth-side upper thread 114C are led to a thread drawing portion 107*a* of the movable knife 107 by the forward movement of the latter 107). In this operation, since the upper thread 114 has been sufficiently drawn into the shuttle hook, the tip end 107*c* of a thread displacing portion 107*b* of the movable knife 107 is positively placed between the cloth-side upper thread 114C and the needle-side upper thread 114N.

And the bobbin thread 104 is displaced by the thread displacing portion 107*b*. The amount of displacement of the bobbin thread 104 is the difference between the distance between the front tip end 107*c* of the thread displacing portion 107*b* and the supporting shaft 108 and the distance between the rear tip end 107*d* of the thread displacing portion 107*b*. In this case, no great forces other than the restoring force of the bobbin thread and the fabric feeding force of the sewing machine are applied to the bobbin thread 104 which has been bent being displaced; however, since the amount of displacement is small, the bobbin thread 104 is restored sufficiently.

Next, the cloth-side upper thread 114C is displaced by the thread displacing portion 107*b*. When compared with the bobbin thread 104, the upper thread 114 is greatly affected in behavior, for instance, by the pull-up operation of the thread take-up lever and the thread take-in operation of the shuttle hook, so that the cloth-side upper thread 114C is moved in the direction of the arrow in FIG. 14. In this case, since the direction of the arrow is coincident with the direction of forward movement of the movable knife 107, the amount of displacement of the cloth-side upper thread 114C is minimized.

Thereafter, the movable knife 107 is retracted maximumly, so that the cloth-side upper thread 114C thus displaced moves over the thread displacing portion 107*b* of the movable knife 107 to reach the thread drawing portion 107*a*. Next, the movable knife 107 is returned, so that the cloth-side upper thread 114C and the bobbin thread 104 are caught by the thread drawing portion 107*a* in the stated order, and the upper thread 114 is pulled upwardly by the thread take-up lever, and its part is held as wound around the movable knife 107.

Under this condition, the bobbin thread 104, being pulled out by the movable knife 107, is let out as much as required. If, in this operation, the bobbin thread is pulled out too fast, then the bobbin is excessively turned, which adversely affects the following sewing operation. In order to eliminate this difficulty, the speed of return of the movable knife 107 is suitably controlled. After cut, the part of the upper thread 114 which is held by the movable knife 107 is a remaining thread on the side of the needle.

Next, the cloth-side upper thread 114C and the bobbin thread 104 are cut with the thread cutting edge 107*e* (the edge of the front end of a so-called "eye") of the movable knife and a stationary knife. The cutting position is just beside the needle hole. Hence, the thread left on the rear side of the fabric is short, so that the resultant stitches are high in quality.

Thus, by setting the width of the movable knife 107 to a suitable value, and by determining the configuration of the thread control hole 106 of the shuttle hook race cap 105 and the thread cutting direction in the above-described manner, it is possible to make the end portions of the needle-side upper thread and the bobbin thread long enough to start the following sewing operation satisfactorily.

A sewing machine employing the DBS shuttle hook and a sewing machine employing the DPS shuttle hook may be compared with each other as follows:

FIGS. 15A and 15B show comparison between those sewing machines. In FIG. 15A, reference numeral 111 designates the DBS shuttle hook; 112, the sharp protrusion of the latter 111; 113, the needle; 114, the upper thread; and R, the upper thread loop. In FIG. 15B, reference numeral 115 designates the DPS shuttle hook; and 116, the sharp protrusion of the latter 115.

In the case where the DBS shuttle hook 111 is employed, the distance (1) between the needle drop point and the bobbin thread lead-out point is as shown in FIG. 5A; while in the case where the DPS shuttle hook 115 is employed, the distance (2) between the needle drop point and the bobbin thread lead-out point is as shown in FIG. 15B. That is, the distance (2) is larger than the distance (1). This is an important difference between the two cases.

That is, fundamentally, in a sewing machine employing the DPS shuttle hook 115, the distance (2) between the needle drop point and the bobbin thread lead-out point is shifted laterally (offset) as much as (the width of the lace of the shuttle hook body +α (alpha)) when compared with the distance (1) between the needle drop point and the bobbin thread lead-out point in the sewing machine employing the DBS shuttle hook 111.

As a result, the force of the thread take-up lever (not shown) to pull up the upper thread 114 is markedly decreased. This is a fundamental factor which adversely affects the tightening of the thread.

Incidentally, when the needle 113 is held not to pass the fabric, the latter is fed, and at the same time the thread take-up lever operates to tighten the thread.

FIGS. 16A and 16B show states of the shuttle hook bodies with a fabric feeding mechanism in operation. More specifically, FIG. 16A shows the engaging member 101 which stops the rotation of the bobbin casing in the sewing machine using the DBS shuttle hook; and FIG. 16B shows the engaging member 101 which stops the rotation of the bobbin casing in the sewing machine using the DPS shuttle hook. In FIG. 16A, reference numeral 121 designates a shuttle hook race ring; 122, an engaging groove; 123, a throat plate; and 124, a needle hole (needle passing hole). Further in FIG. 16A, reference character A designates an arrow indicating a fabric feeding direction; and CW, an arrow indicating the direction of rotation of the DBS shuttle hook 111 (clockwise direction). In FIG. 16B, reference character B designates an arrow indicating a fabric feeding direction; and CCW, an arrow indicating the direction of rotation of the DPS shuttle hook (counterclockwise direction).

FIGS. 17A and 17B are enlarged diagrams showing essential components shown in FIGS. 16A and 16B, respectively.

The bobbin thread 104 is pulled by the fabric feeding force as indicated by the arrows A and B in FIGS. 16A and 16B. As a result, in the case of the DBS shuttle hook 111, the bobbin casing 100 is turned in the direction of the arrow CW (clockwise) as shown in FIG. 16A; and in the case of the DPS shuttle hook 115, the bobbin casing 100 is turned in the direction of the arrow CCW (counterclockwise) as shown in FIG. 16B.

As a result, in the case of the DBS shuttle hook 111, as shown in FIG. 17A the engaging member 101 is pushed to the right against the engaging groove 122 of the shuttle hook race ring 121 which is able to stop the rotation of the bobbin casing 100; and in the case of the DPS shuttle hook 115, as shown in FIG. 17B the engaging member 101 is pushed to the left against the engaging groove 122 of the shuttle hook race ring 121.

In this connection, as for the upper thread 114, a movable side (the side of the needle 113) and a stationary side (the side of the fabric) should be taken into consideration. In the case of the DBS shuttle hook 111, as shown in FIG. 17A the loop R of the upper thread on the movable side (the side of the needle 113) to which the pull-up force of the thread take-up lever is readily transmitted enters the space between the engaging member 101 and the right wall surface of the engaging groove 122.

As is apparent from comparison of FIG. 15A and 15B, in the case of the DBS shuttle hook 111, the angle of entrance of the loop R is such that the latter is much less in the amount of offset than in the case of the DPS shuttle hook 115. And the loop is pulled upwardly with respect to the engaging member 101, which readily permits the passage of the upper thread 114 as shown in FIG. 18.

On the other hand, in the case of the DPS shuttle hook 115, as shown in FIG. 17B the loop R of the upper thread 114 which enters the space between the engaging member 101 and the left wall surface of the engaging groove 122 comes on the stationary side (on the side of the fabric), and therefore the force of the thread take-up lever is scarcely transmitted to it, and the loop is larger in the amount of offset than in the case of the DBS shuttle hook 111. In addition to this disadvantage, the upper thread 114 turns around the engaging member 101 from above, and therefore it becomes rather difficult to leave from the engaging member.

Those difficulties depend on the fabric feeding direction and on the stitching pitch, and are most significantly encountered when the stitching pitch is large and the fabric is fed in a right-to-left direction.

Mainly because of those difficulties, the thread is unevenly tightened.

When leaving from the DPS shuttle hook 115, the upper thread 114, depending on the timing of entrance of a driver adapted to drive the shuttle hook body, is generally shaped as shown in FIGS. 19A and 19B. In FIGS. 19A and 19B, reference numeral 131 designates the driver.

In this case, the thickness of the inner side portion of the driver 131 and its curvature (radius), and the width of the right and left flanges of the thread disengaging section must be taken into account. If the driver 131 is made thin, then the upper thread 114 may be tightened well, and its resistance is decreased. However, the modification of the driver 131 in the above-described manner gives rise to another problem. That is, in the case where the thread is used which is high in twist movement or is liable to run (vibrate) being high in tension, the thread itself is twisted, so that it is unevenly tightened or forms unwanted loops.

On the other hand, it is important for operational balance that the time instant that the upper thread disengages from the driver 131 occurs slightly later than the time instant that the upper thread disengages from the engaging member 101 of the bobbin casing 100. This fact eliminates difficulties that the thread is unintentionally twisted, and it forms unwanted loops or knots.

In the case of the DPS shuttle hook 115, because of the difficulties described with reference to FIG. 17B, the thread 114 is increased in resistance being pushed as indicated by the arrow (*), and the timing that the thread leaves from the engaging member is delayed with respect to the timing that the thread leaves from the driver 131, as a result of which the upper thread 114 remains over the engaging member 101 of the bobbin casing 100.

As a result, the thread 114 caught by the engaging member 101 of a thread disengaging section which is larger in the amount of offset than in the case of the DBS shuttle hook, is pulled sideward, thus forming unwanted loops and knots.

In this connection, it may be thought of that, if the upper thread is smoothly disengaged from the engaging member of a bobbin casing whose thread disengaging portion is made larger in the amount of offset than in a sewing machine using the DBS shuttle hook so that it is applicable to a sewing machine using the DPS shuttle hook, thus forming no unwanted loops or knots, then the resultant stitches will be fine in quality.

That is, the use of the thread hole of the engaging member of the bobbin casing should be omitted, to improve the tightening of the thread in quality. In addition, a bobbin casing should be formed which has no thread hole.

Referring back to FIG. 12, the bobbin thread 104 supplied from the bobbin 103 in the bobbin casing 100 of the DBS shuttle hook is passed through the thread hole 102 of the engaging member 101 of the bobbin casing 100. Accordingly, as shown in FIGS. 13 and 14, the end portion of the bobbin thread 104 which has been cut and located in the thread control hole 106 of the shuttle hook race cap is held stable.

However, in the case where the bobbin casing is applied to the DPS shuttle hook with the use of the thread hole of its engaging member of the bobbin casing omitted in view of the quality of the tightening of the thread, an ill effect is produced; that is, the end portion of the bobbin thread which has been cut in the thread control hole of the shuttle hook race cap is unstable.

SUMMARY OF THE INVENTION

In view of the foregoing, an object of the invention is to provide a bobbin thread end holding device for a sewing machine which, in the case where a bobbin casing is applied to a DPS shuttle hook by omission of the use of the thread hole of its engaging member, stabilizes the end portion of the bobbin thread which has been cut.

In order to achieve the object, a first aspect of the present invention provides a bobbin thread end holding device in a sewing machine in which an upper thread and a bobbin thread, for holding an end portion of the bobbin thread after cut. The bobbin thread end holding device has a cutter for cutting the upper thread and the bobbin thread, and a bobbin thread control member. The bobbin thread control member includes: a thread control hole into which the upper thread and the bobbin thread are led; and a prolongation extending from the control hole, for outwardly introducing the end portion of the bobbin thread cut by the cutter from the control hole.

A second aspect of the invention provides the bobbin thread end holding device according to the first aspect, wherein the prolongation includes a labyrinth section which prevents the end portion of the bobbin thread led therein from returning to the thread control hole.

A third aspect of the invention provides the bobbin thread end holding device according to the second aspect, wherein the labyrinth section includes: a bobbin thread lead-in groove which is substantially linear; and a bobbin thread holding member positioned adjacent to an end of the bobbin thread lead-in groove, and having a gap for introduction of the end portion of the bobbin thread, for preventing the end portion of the bobbin thread from returning to the thread control hole.

A fourth aspect of the invention provides the bobbin thread end holding device according to the second aspect, wherein the labyrinth section has a labyrinth-shaped bobbin thread lead-in groove which has a plurality of bends, serving as the prolongation.

In the bobbin thread end holding device of the first aspect, the end portion of the bobbin thread is introduced into the prolongation which is extended outwardly from the thread control hole of the thread control plate. Hence, the end portion of the bobbin thread which has been cut with the thread cutting device is stably held in the prolongation of the thread control hole.

In the bobbin thread end holding device of the second aspect, the labyrinth section formed in the prolongation of the thread control hole positively prevents the end portion of the bobbin thread introduced into the prolongation from returning to the thread control hole. Thus, with the aid of the labyrinth section, the end portion of the bobbin thread which has been cut with the thread cutting device is held positively and stably in the prolongation of the thread control hole.

In the bobbin thread end holding device of the third aspect, the labyrinth section is made up of the bobbin thread lead-in groove which is substantially linear, serving as the prolongation, and the bobbin thread holding member which is positioned near the end of the bobbin thread lead-in groove. When the end portion of the bobbin thread is led into the end portion of the bobbin thread lead-in groove through the gap between the bobbin thread lead-in groove and the bobbin thread holding member, the bobbin thread holding member positively prevents the end portion of the bobbin thread from returning to the thread control hole. Hence, with the aid of the bobbin thread holding member, the end portion of the bobbin thread which has been cut with the thread cutting device is positively stably held at the end of the bobbin thread lead-in groove which is substantially linear.

In the bobbin thread end holding device of the fourth aspect, the labyrinth section is made up of the labyrinth-shaped bobbin thread lead in groove which has a plurality of bends, serving as the prolongation of the thread control hole. Hence, when the end portion of the bobbin thread is introduced into the labyrinth-shaped bobbin thread lead-in groove, the bends positively prevent the end portion of the bobbin thread from returning to the thread control hole. Hence, with the aid of the plurality of bends of the bobbin thread lead-in groove, the end portion of the bobbin thread which has been cut with the thread cutting device is held positively stably at the end of the bobbin thread lead-in groove.

BRIEF DESCRIPTION OF THE DRAWINGS

FIGS. 7A to 7C are perspective views showing a step in which relevant parts are in standby state, a step of starting the displacement of an upper thread, and a step of displacing the upper thread, respectively; FIGS. 7D to 7F are perspective view showing a step of displacing a bobbin thread, a step of retracting the movable knife maximumly, and a step of catching the bobbin thread and the upper thread with the movable knife, respectively; FIG. 7G to 7I are also perspective views showing a step of letting the bobbin thread out and pulling the upper thread upwardly, a step of cutting the threads, and the final state in which those relevant parts are at rest at the end of the thread cutting operation, respectively;

FIG. 16A is a front view showing an engaging member which stops the rotation of the bobbin casing in the sewing machine using the DBS shuttle hook; and 16B is also a plan view showing an engaging member which stops the rotation of the bobbin casing in the sewing machine using the DPS shuttle hook;

DETAILED DESCRIPTION OF THE PREFERRED EMBODIMENTS

A bobbin thread end holding device for a sewing machine according to the invention will be described with reference to FIGS. 1 through 9.

Figure 1:
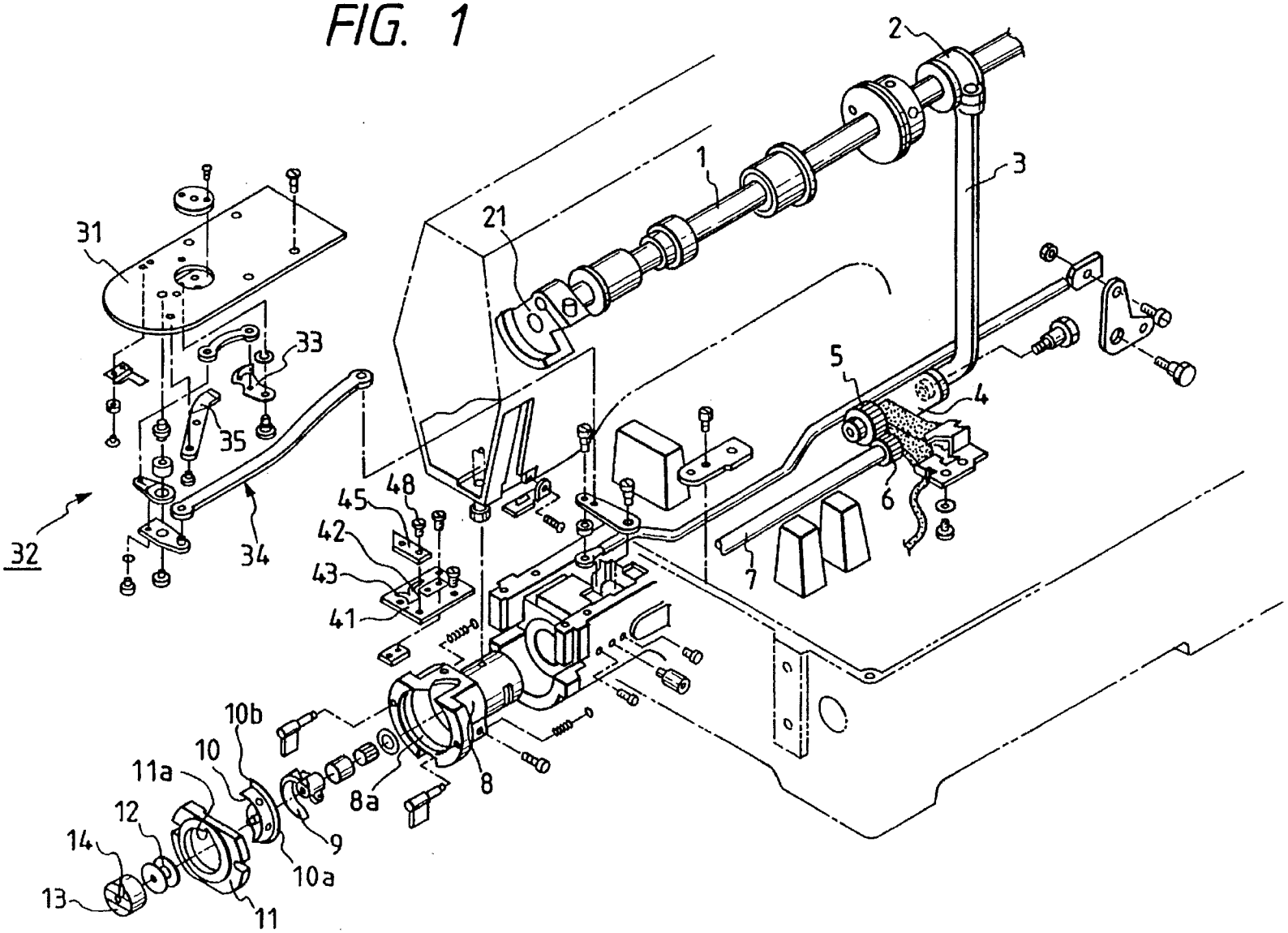
FIG. 1 is an exploded perspective view showing the arrangement of a shuttle hook driving device in a sewing machine to which the technical concept of the invention is applied.

FIG. 1 is an exploded perspective view showing the arrangement of a shuttle hook driving device in a sewing machine to which the technical concept of the invention is applied. In FIG. 1, reference numeral 1 designates a spindle (or arm shaft); 2, a crank section; 3, a crank rod; 4, an oscillating rock shaft; 5 and 6, gears; 7, an oscillating shaft; 8, a shuttle hook race body; 9, a driver; 10, a shuttle hook body (or DPS shuttle hook); 11, a shuttle hook race ring; 12, a bobbin; 13, a bobbin casing; 14, an engaging member of the bobbin casing 13; 21, a counter balance; 31, a throat plate; 32, a thread cutting device; 33, a movable knife; 34, a movable knife driving mechanism; 35, a stationary knife; 41, a thread control plate (or shuttle hook race cap); 42, a thread control hole; 43, an extension (or bobbin thread lead-in groove which is straight); and 45, a bobbin thread holding member (or bobbin thread holding plate).

The spindle of the sewing machine, namely, the arm shaft 1 has a pulley (not shown) at the right end to which the torque of the electric motor is applied through an endless belt. The arm shaft 1 has the crank section 2, to which the upper end portion of the crank rod 3 is coupled. The lower end portion of the rank rod 3 is eccentrically coupled to the oscillating rock shaft 4.

The gears 5 and 6 are mounted on the oscillating rock shaft 4 and the oscillating shaft 7, respectively, in such a manner that they are engaged with each other. Near the left end of the oscillating shaft 7, the shuttle hook race body 8 is fixedly secured to the sewing machine body.

The driver 9 is coupled to the left end of the oscillating shaft 7, and rotatably provided inside the shuttle hook race body 8. In addition, the DPS shuttle hook 10, which is the shuttle hook body driven by the driver 9, is also rotatably provided inside the shuttle hook race body 8.

The DPS shuttle hook 10 has a race 10*a* along its outer periphery, so that it is slidably set in the shuttle hook race body 8 through the race 8*a* of the latter 8. A sharp protrusion 10*b* is formed at an extension from the race 10*a*. The DPS shuttle hook 10 is turned counterclockwise by the driver 9.

The shuttle hook race ring 11 is fixedly secured to the shuttle hook race body 8. The bobbin casing 13 accommodating the bobbin 12 is set in the shuttle hook race body 8 through the opening of the shuttle hook race ring 11.

The bobbin casing 13 has the engaging member 14 which is protruded outwardly. The shuttle hook race ring 11 has an engaging groove 11*a* with which the engaging member 14 is engaged.

Figure 2:
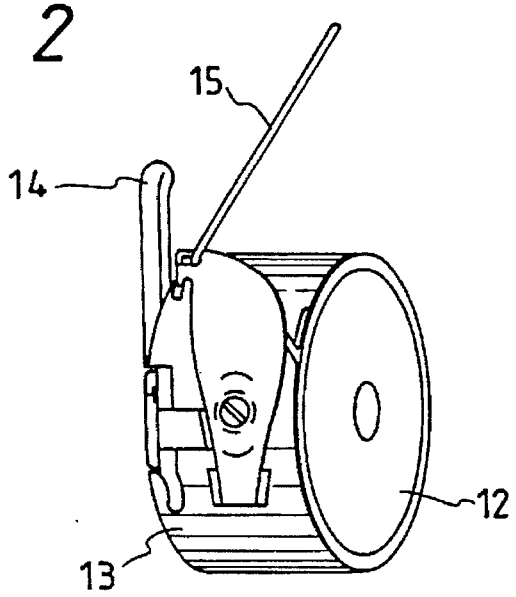
FIG. 2 is a perspective view of a bobbin casing.

As shown in FIG. 2, the engaging member 14 of the bobbin casing 13 is smaller in the amount of protrusion than the conventional one, and it, unlike the conventional one, has no thread hole. Hence, the bobbin thread 15 wound on the bobbin 12 is merely led out of the bobbin casing 13 irrespective of the engaging member 14.

The length of the engaging member 14 is determined from the position of the driver 9. That is, the length of the engaging member 14 is so determined that, under the condition that the angle of rotation of the arm shaft 1 is in a range of 5° to 35° with the top dead point of the needle bar as a reference (0°), the upper end of the engaging member 14 comes below the upper surface of the driver The counter balance 21 is coupled to the left end of the arm shaft 1. In front of the counter balance 21, a thread take-up lever, needle bar crank, needle bar crank rod, needle bar, and needle are provided, as is well known in the art.

The throat plate 31 is provided above the shuttle hook race body 8. The thread cutting device 32 (including the movable knife 33, the movable knife driving mechanism 34, and the stationary knife 35) and the thread control plate (or shuttle hook race cap) 41 are provided between the throat plate 31 and the shuttle hook race body 8.

In the sewing machine thus designed, the torque of the motor is applied through the endless belt to the pulley, so that the arm shaft 1 is rotated to drive the needle, while the full turn motion of the arm shaft 1 is converted into the swing motion of the oscillating rock shaft 4 with the aid of the crank section 2 and the crank rod 3.

The swing motion of the oscillating rock shaft 4 is transmitted through the gears 5 and 6 to the oscillating shaft 7; that is, it is converted into the half turn motion of the latter 7. Hence, the DPS shuttle hook 10, being driven by the driver 9 which is integral with the oscillating shaft 7, performs a half turn motion in the counterclockwise direction.

Figure 10:
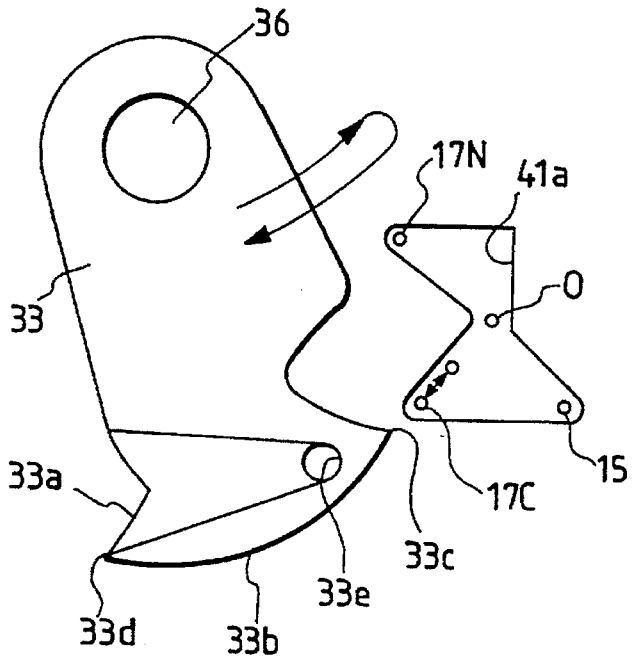
FIG. 10 is a plan view showing an example of the fundamental configuration of a thread control hole in a sewing machine using a DPS shuttle hook, and relationships between the thread control hole and a movable knife.

It is assumed that, in the sewing machine having the above-described DPS shuttle hook, the thread control plate (or shuttle hook race cap) 41 has a thread control hole 41*a* as shown in FIG. 10. In this case, first a movable knife 33 having a supporting shaft 36 on the left side of a needle drop point O as viewed from the operator is held with it is thread displacing portion 33*b* faced forward; that is, it is held at a standby position. In FIG. 10, reference character 17C designates a cloth-side upper thread; and 17N, a needle-side upper thread.

The movable knife 33 displaces the cloth-side upper thread 17C prior to the bobbin thread 15. The movable knife 33 has a thread cutting edge 33*e* (the front edge of a so-called "eye") which cooperates with the thread cutting edge of the stationary knife 35 to cut the cloth-side upper thread 17C and the bobbin thread 15.

The movable knife 33 is swung as indicated by the arrow with the aid of a thread cutting cam (not shown) and the movable knife driving mechanism 34; that is, it is swung counterclockwise ("go" swing), and clockwise ("return" swing).

In the "go" swing of the movable knife 33, the cloth-side upper thread 17C is first displaced from the thread displacing portion's front end 33*c* by the thread displacing portion 33*b*, and then the bobbin thread 15 is displaced. In the "return" swing of the movable knife 33, the bobbin thread 15 and the cloth-side upper thread 17C are caught by the thread drawing portion 33*a* through the thread displacing portion's rear end 33*d*, and the threads are cut with the thread cutting edge 33*e*.

More specifically, the movable knife 33 is counterclockwise swung from the standby position ("go" swing), and the cloth-side upper thread 17C and the bobbin thread 15 are displaced from the thread displacing portion's front end 33*c* by the thread displacing portion 33*b* in the stated order. Next, the movable knife 33, after being retracted maximumly, is swung clockwise ("return" swing), so that the bobbin thread 15 and the cloth-side upper thread 17C are laid over the thread drawing portion 33*a* in the state order.

The movable knife 33 is further swung clockwise ("return" swing), the bobbin thread 15 is let out of the bobbin casing 13, and the upper thread 17 is pulled upwardly by the shuttle hook take-up lever (not shown). The movable knife 33 is further swung clockwise, so that the cloth-side upper thread 17C and the bobbin thread 15 are cut with the thread cutting edge 33*e* cooperating with the stationary knife 35.

The cloth-side upper thread 17C and the bobbin thread 15 are cut with the thread cutting device 32 in the above-described manner. In this connection, as shown in FIG. 2, the bobbin thread 15 wound on the bobbin 12 is left led out of the bobbin casing 13 without passing through the engaging member 14 of the bobbin casing, and therefore the end portion of the bobbin thread 15 which has been cut is located unstably in the thread control hole 41*a* of the shuttle hook race cap 41.

Figure 11:
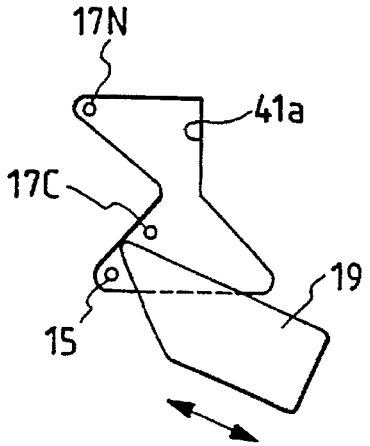
FIG. 11 is a plan view showing a thread control hole together with a movable bobbin thread holding member.
Figure 12:
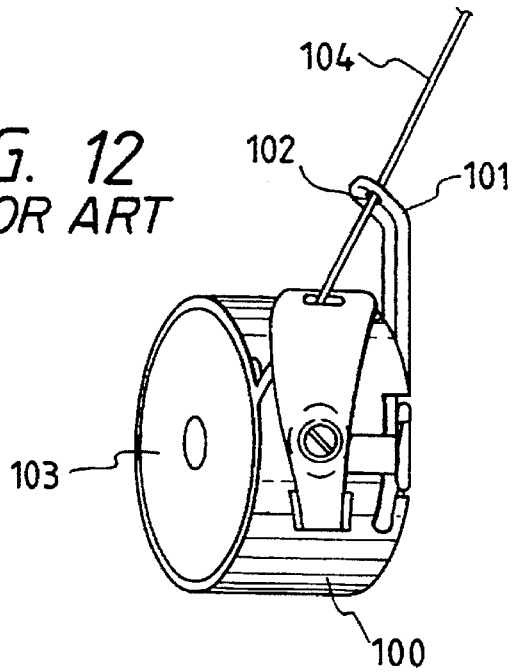
FIG. 12 PRIOR ART
FIG. 12 is a perspective view showing a conventional bobbin casing provided for an ordinary half-turn shuttle hook.
Figure 13:
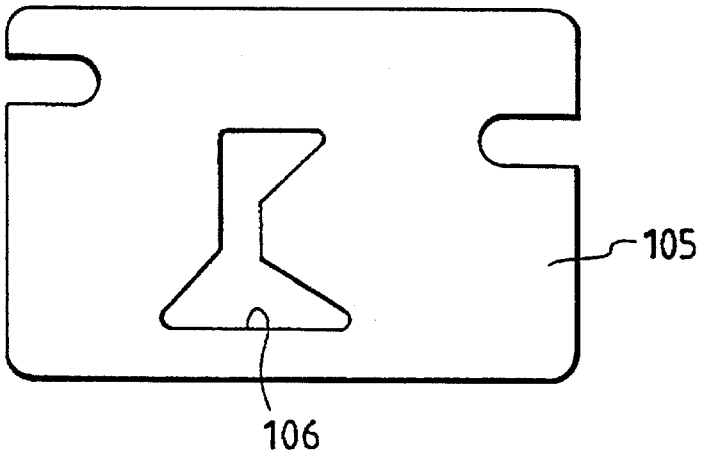
FIG. 13 is a plan view of a shuttle hook race cap, showing an example of the fundamental configuration of a thread control hole in a sewing machine using a DPS shuttle hook.
Figure 14:
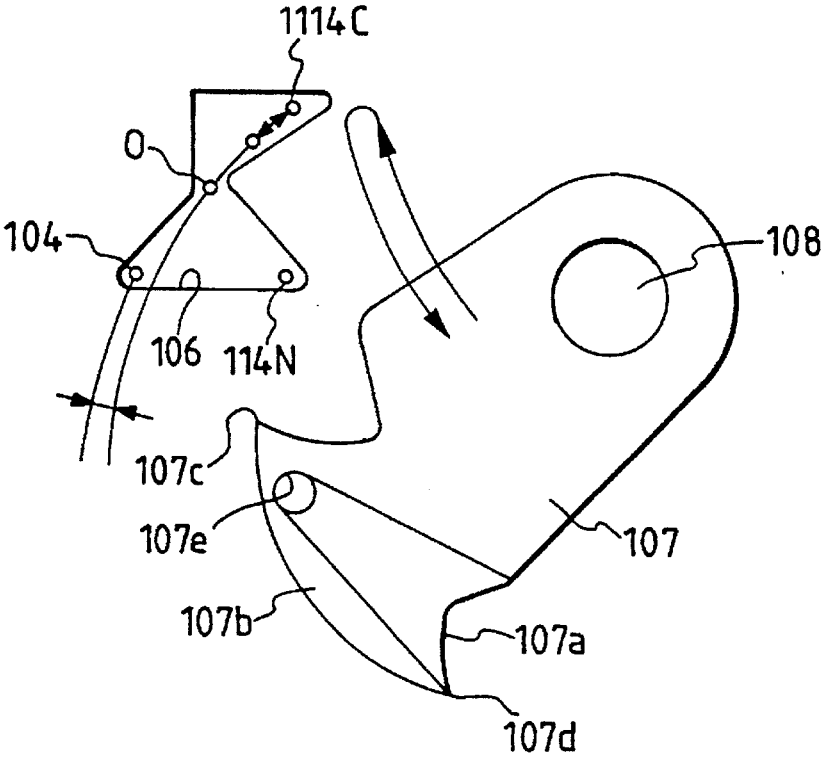
FIG. 14 is a plan view showing relationships between the thread control hole shown in FIG. 15 and a movable knife.
Figure 15A:
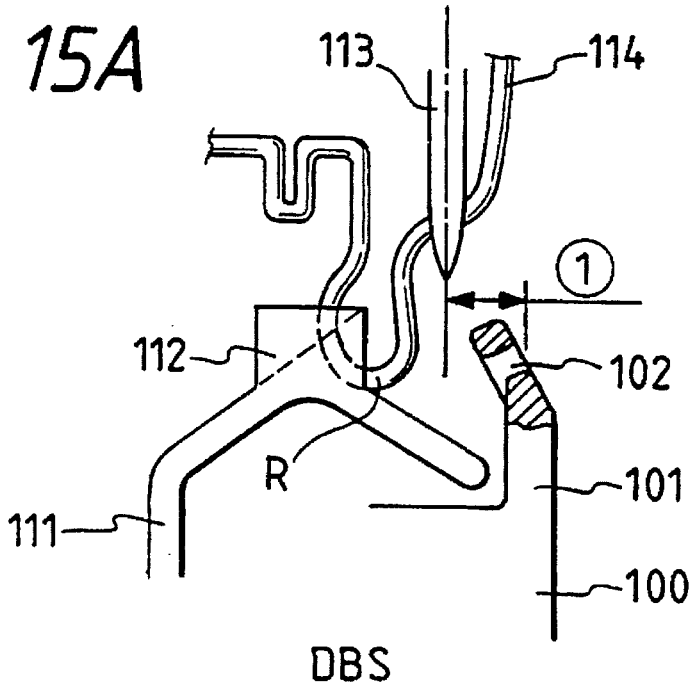
FIG. 15A is a sectional view, with parts cut away, showing the distance between a needle drop point and a bobbin thread lead-out point in a sewing machine using the DBS shuttle hook.
Figure 15B:
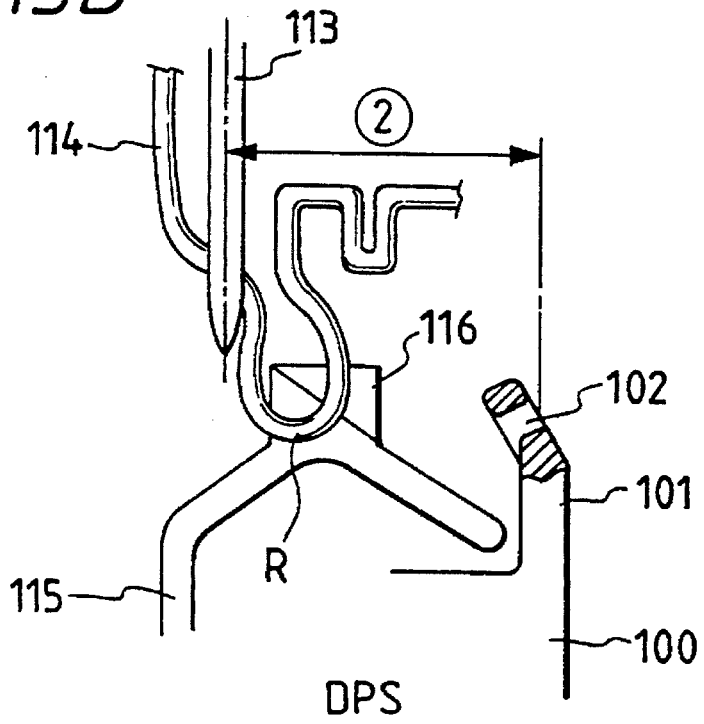
FIG. 15B is also a sectional view, with parts cut away, showing the distance between a needle drop point and a bobbin thread lead-out point in a sewing machine using the DPS shuttle hook.
Figure 16A:
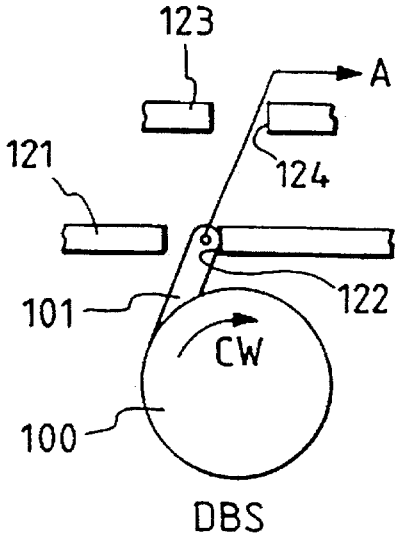
FIGS. 16A and 16B show states of the shuttle hook bodies with a fabric feeding mechanism in operation. More specifically.
Figure 16B:
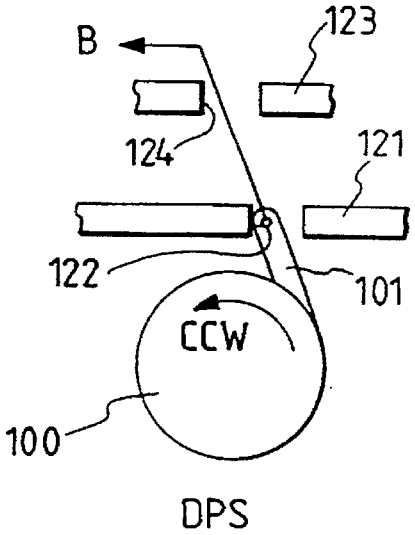
Figure 17A:
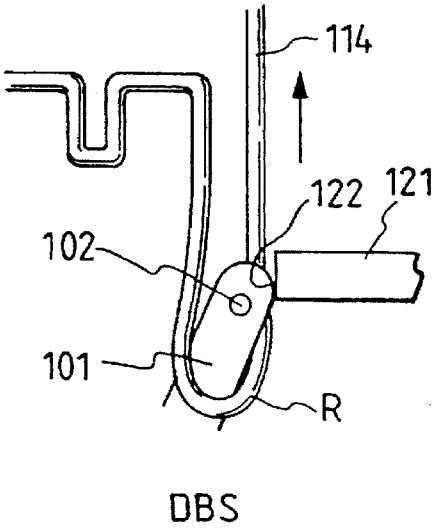
FIGS. 17A and 17B are enlarged diagrams showing essential components shown in FIGS. 16A and 16B, respectively.
Figure 17B:
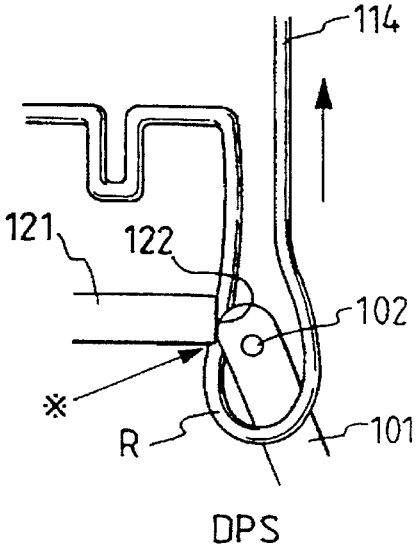
Figure 18:
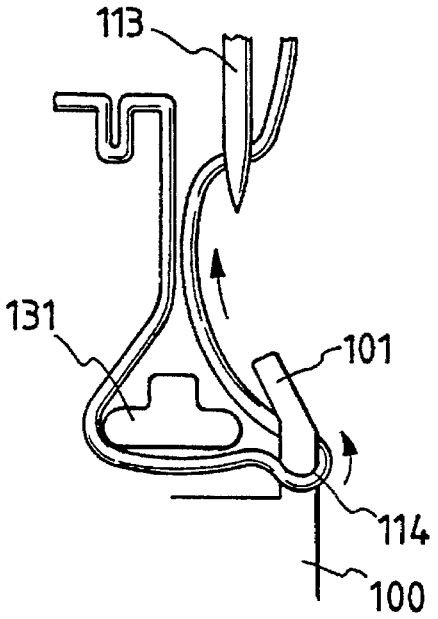
FIG. 18 is a side view showing how the upper thread's loop disengaged s from the engaging member of the bobbin casing in the sewing machine using the DBS shuttle hook.
Figure 19A:
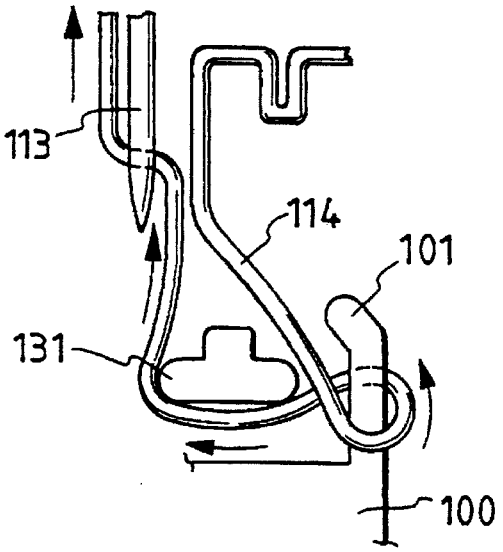
FIGS. 19A and 19B are a front view and a side view, respectively, showing how the upper thread's loop disengages from the engaging member of the bobbin casing in the sewing machine using the DPS shuttle hook.
Figure 19B:
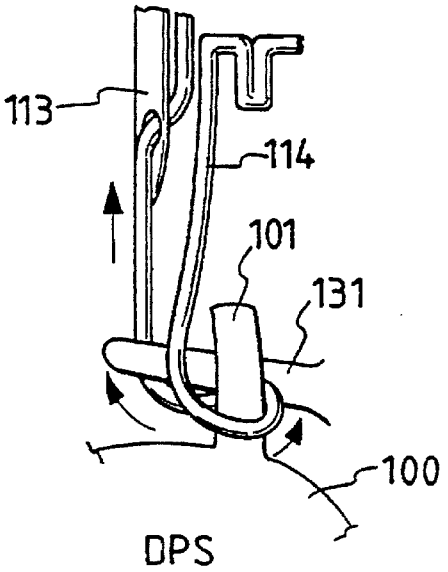

This difficulty may be eliminated by the provision of a bobbin thread holding member 19 which, as shown in FIG. 11, is protruded in the thread control hole 41*a* to locate the bobbin thread 15 at the corner of the latter 41*a*.

In this connection, it should be noted that, in addition to the bobbin thread 15, the cloth-side upper thread 17C and the needle-side upper thread 17N are located in the thread control hole 41*a*, and that, in the thread cutting operation, the cloth-side upper thread 17C is moved to meet the bobbin thread 15 at the corner of the thread control hole 14*a* where the bobbin thread holding member 19 is protruded. Hence, inevitably the bobbin thread holding member 19 must be so designed that it is movable back and forth.

However, the employment of the movable bobbin thread holding member 19 which is moved in and out of the thread control hole 41*a* of the shuttle hook race cap 41 suffers from the following difficulties. That is, control means must be provided to prevent the interference of the bobbin thread holding member with the cloth-side upper thread 17C, and to hold the bobbin thread at the corner of the thread control hole 41*a*; however, those control means are intricate, and high in manufacturing cost.

Figure 3:
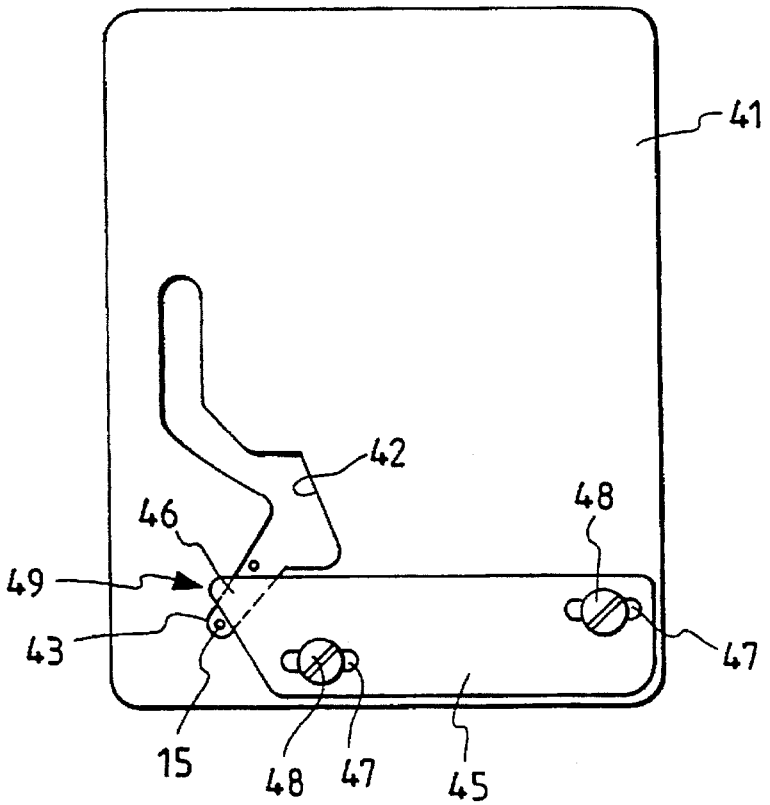
FIG. 3 is a plan view of a shuttle hook race cap in an example of a bobbin thread holding device, which constitutes a first embodiment of the invention.

In view of the foregoing, in a first embodiment of the invention, as shown in FIG. 3 a thread control hole 42 is formed in the shuttle hook race cap (or thread control plate) 41, and a bobbin thread lead-in groove 43 is straightly extended from the lower left corner of the thread control hole 42, and a bobbin thread holding plate (or bobbin thread holding member) 45 is provided in such a manner that it covers the bobbin thread lead-in groove 43 from above except the end portion of the latter.

The thread control hole 42 is to suitably handle the bobbin thread 15 and the upper thread 17. That is, with the bobbin thread 15 and the upper thread 17 located in the thread control hole 42, the needle-side upper thread 17N and the cloth-side upper thread 17C and the bobbin thread 15 are positioned in place by the thread control hole 42 in the thread cutting operation which is performed with the movable knife 33 and the stationary knife 35 of the thread cutting device 32. The thread control hole 42 is shaped as shown in FIG. 3, to perform the above-described functions.

In the first embodiment, a bobbin thread holding plate 45 has a bobbin thread regulating portion 46 at the left end as viewed in FIG. 3 which is tapered. The bobbin thread holding plate 45 is fixedly secured to the shuttle hook race cap 41 with fixing screws 48 and 48 inserted in two elongated adjusting holes 47 and 47 formed in the shuttle hook race cap 41.

With the bobbin thread holding plate 45 thus secured, the tapered bobbin thread regulating portion covers the bobbin thread lead-in groove 43 of thread control hole 42 except the end portion, and a gap is formed between the bobbin thread holding plate 45 and the shuttle hook race cap 41 which is large enough for the bobbin thread 15 to pass through.

Hence, the tapered bobbin thread regulation portion 46 of the bobbin thread holding plate 45 and the part of the bobbin thread lead-in groove 43 which is covered by the bobbin thread regulating portion 46 (hereinafter referred to as "an overlap part", when applicable) form a labyrinth section 49 for the passage of the bobbin thread 15.

As was described above, the shuttle hook race cap 41 has the thread control hole 42 and the bobbin thread lead-in groove 43 which is linearly extended from the former 42. In addition, the shuttle hook race cap 41 has the bobbin thread holding plate 45 including the bobbin thread regulating portion 45 which covers the bobbin thread lead-in groove 43 except the end portion, thus forming the labyrinth section 49. Therefore, in cutting the cloth-side upper thread 17C and the bobbin thread 15 with the movable knife 33 cooperating with the stationary knife 35, the bobbin thread 15 is moved from the thread control hole 42 into the linearly extended bobbin thread lead-in groove 43.

Thereafter, in the bobbin thread lead-in groove 43, the bobbin thread 15 is moved through the gap between the tapered bobbin thread regulating portion 46 of the bobbin thread holding plate 45 and the upper surface of the shuttle hook race cap 41 and through the labyrinth section 49 to the end portion of the bobbin thread lead-in groove 43. When the bobbin thread 15 reaches the end portion of the bobbin thread lead-in groove 43 in the above-described manner, the bobbin thread regulating portion 46 prevents the bobbin thread 15 from returning to the thread control hole 42, so that the end portion of the bobbin thread 15 which has been cut is held stably.

Hence, in the case where the sewing machine employing the DPS shuttle hook 10 uses the bobbin casing 13 with the engaging member 14 having no thread hole, with the aid of the labyrinth section 49 the bobbin thread regulating portion 46 can stably hold the end portion of the bobbin thread 15 which has been cut.

Thus, the end portion of the needle-side upper thread is sufficiently long, and the end portion of the bobbin thread 15 is long enough to start the following sewing operation smoothly.

Hence, with the sewing machine employing the DPS shuttle hook, stitches fine in quality can be formed.

Now, the invention will be described with reference to FIGS. 4 through 7I in detail.

Figure 4:
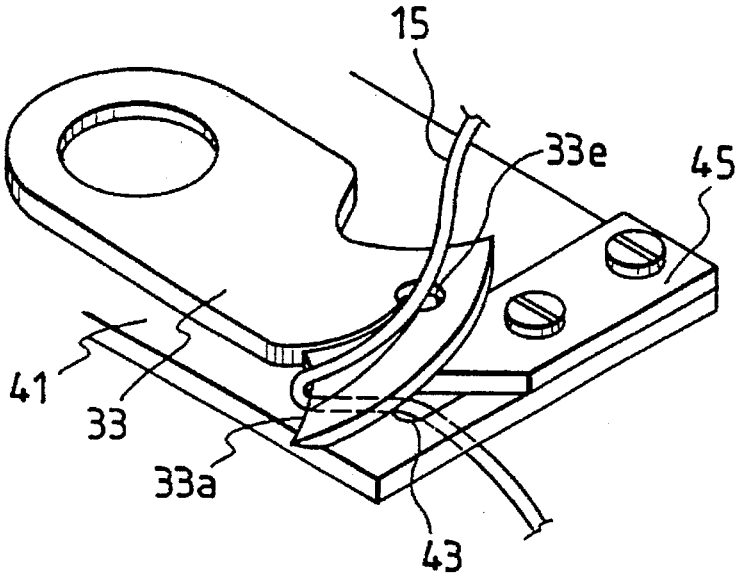
FIG. 4 is a perspective view showing how a bobbin thread and a movable knife are positioned over the shuttle hook race cap immediately before a thread cutting operation.

Immediately before the thread is cut, the bobbin thread 15 over the shuttle hook race cap 41 and the movable knife 33 are positioned as shown in FIG. 4. The bobbin thread 15 which is drawn out being caught by the thread drawing portion 46 of the movable knife 33 is moved through the gap between the tapered bobbin thread regulating portion 46 of the bobbin thread holding plate 45 and the upper surface of the shuttle hook race cap 41 and through the labyrinth section 49 to the end portion of the bobbin thread lead-in groove 43. At the end portion of the bobbin thread lead-in groove 43, the bobbin thread regulating portion 46 prevents the bobbin thread 15 from returning to the thread control hole 42.

Under this condition, the bobbin thread 15 is cut. However, the end portion of the bobbin thread 15 thus cut is held stable in the bobbin thread lead-in groove 43.

Figure 5:
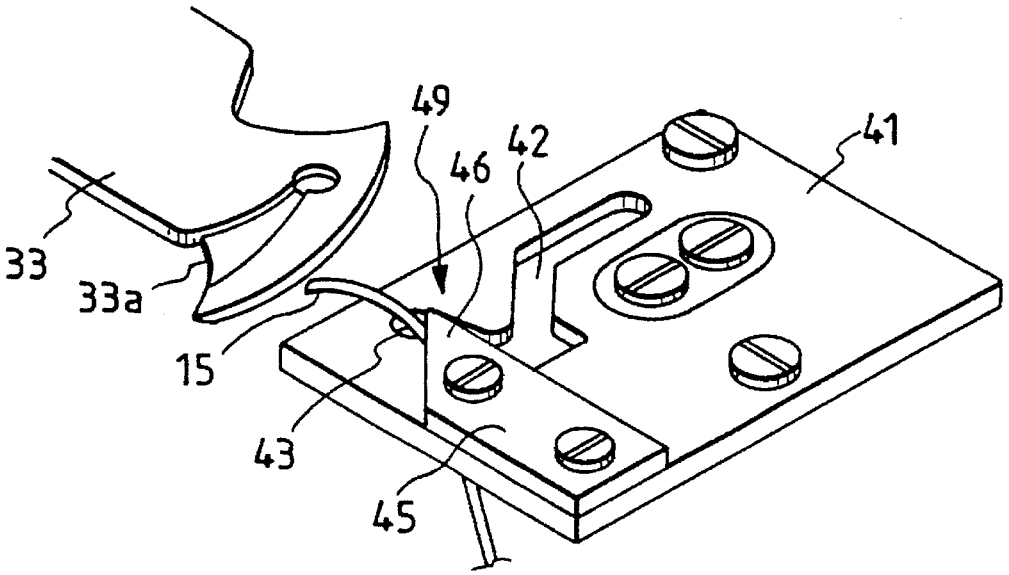
FIG. 5 is also a perspective view showing how the bobbin thread and the movable knife are located after the thread cutting operation.

That is, FIG. 5 shows the end portion of the bobbin thread which has been cut in the manner as shown in FIG. 4. The end portion of the bobbin thread 15 thus cut is held in the bobbin thread lead-in groove 43, being laid a predetermined length over the shuttle hook race cap 41.

Figure 6:
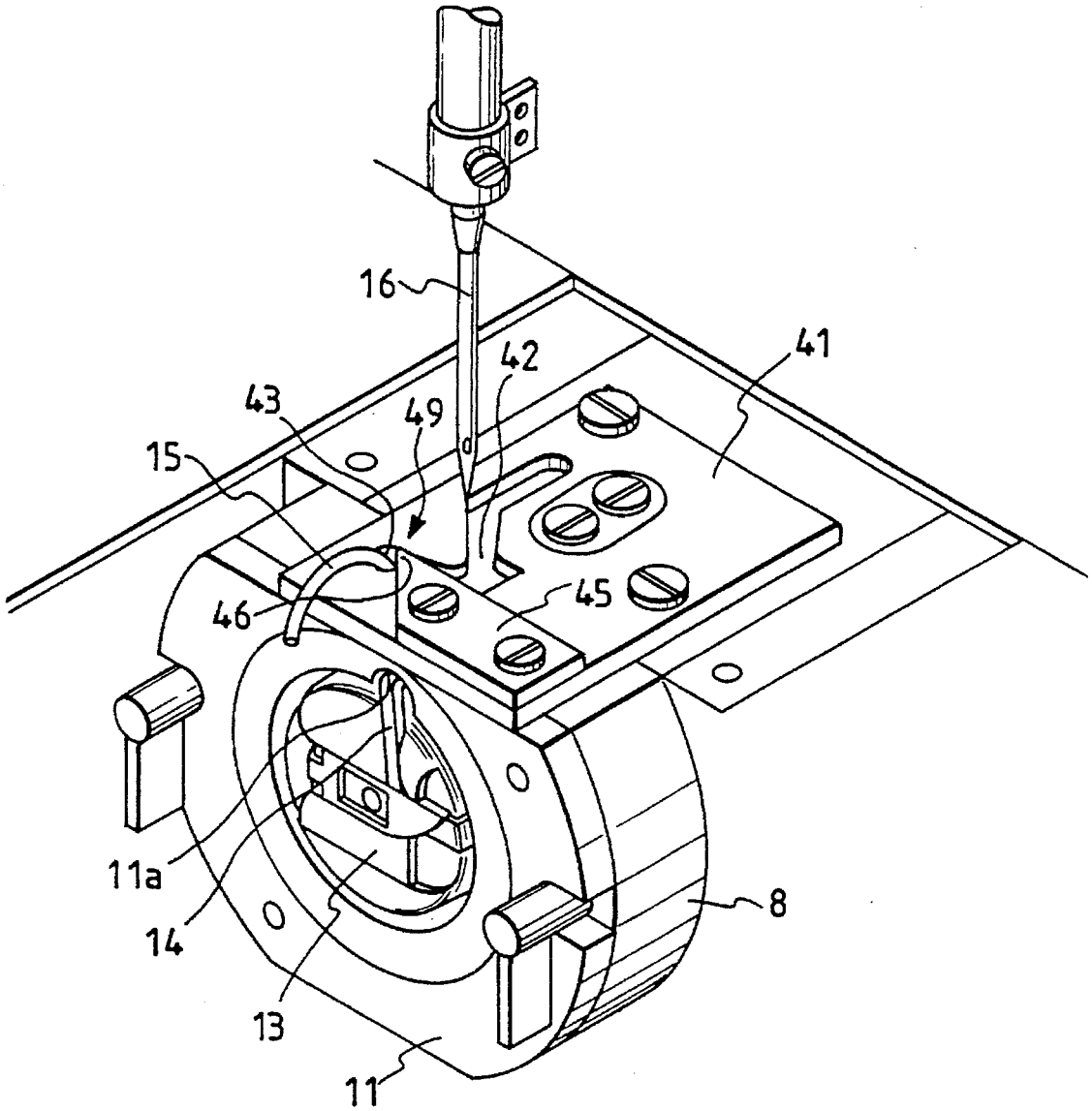
FIG. 6 is a perspective view of a shuttle hook section with a throat plate removed after the thread cutting operation.

FIG. 6 shows the shuttle hook section with the throat plate 32 removed after the cutting of the bobbin thread. In FIG. 6, reference numeral 16 designates the sewing needle. As shown in FIG. 6, the end portion of the bobbin thread 15 which has been cut is held in the bobbin thread lead-in groove 43, being laid a predetermined length over the shuttle hook race cap 41. That is, it is extended over the shuttle hook race ring 11.

Now, the thread cutting operation will be described in detail.

FIGS. 7A through 7I show various steps taken in the thread cutting operation, from a step in which relevant parts are in standby state to a final step in which the relevant parts are at rest at the end of the thread cutting operation. In those figures, reference character C designates a fabric.

Figure 7A:
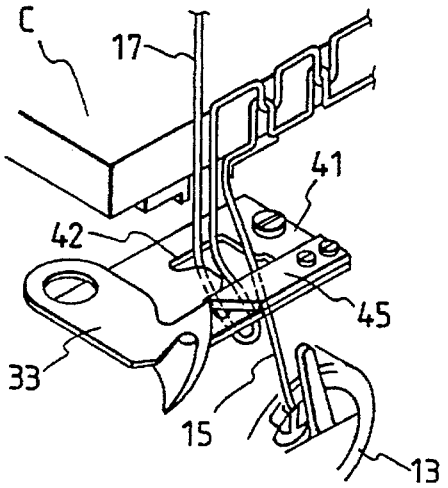
FIGS. 7A through 7I show various steps taken successively in the thread cutting operation.
Figure 7B:
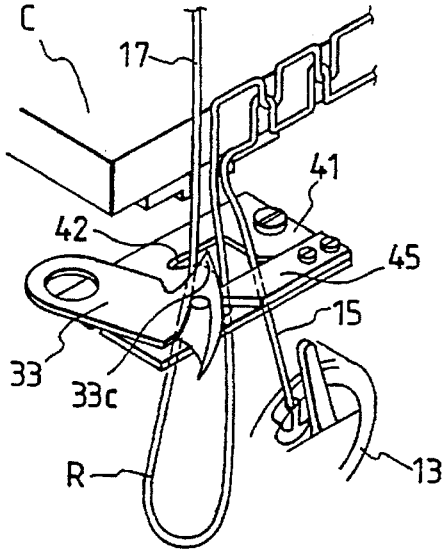

FIG. 7A shows a first step in which the relevant parts are in standby state. Under this condition, the movable knife 33 is swung counterclockwise ("go" swing). FIG. 7B shows a step in which the displacement of the thread is just started. The thread is displaced with the thread displacing portion's front end **33*c* of the movable knife 33**.

Figure 7C:
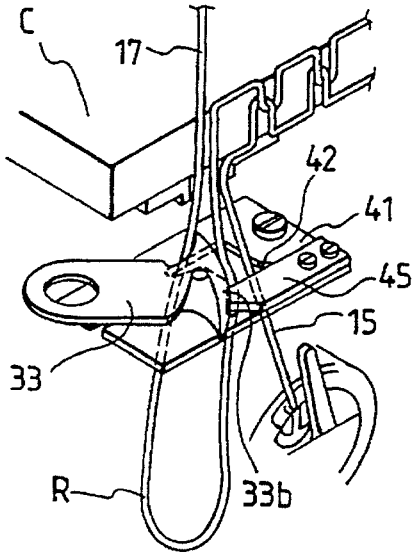

That is, FIG. 7C shows a step in which the upper thread is being displaced with the movable knife 33. More specifically, the upper thread 17 (the cloth-side upper thread 17C with respect to the needle-side upper thread 17N) is first displaced from the thread displacing portion's front end **33*c* by the thread displacing portion 33*b***.

Figure 7D:
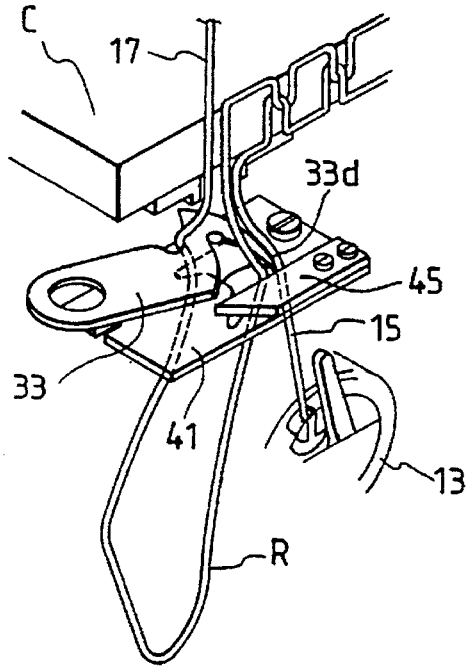

FIG. 7D shows a step in which the bobbin thread is being displaced. In succession with the displacing of the upper thread 17, the bobbin thread 15 is displaced from the thread displacing portion **33*b* of the movable knife 33 by the thread displacing portion's rear end 33*d***.

Figure 7E:
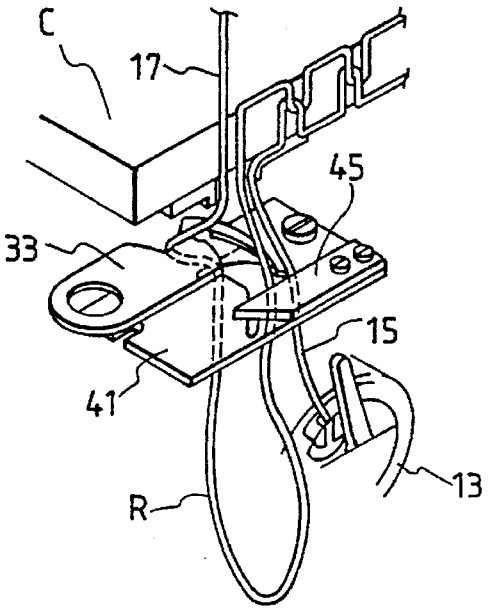

Thereafter, the movable knife 33 is swung maximumly (in the "go" swing) as shown in FIG. 7E.

Figure 7F:
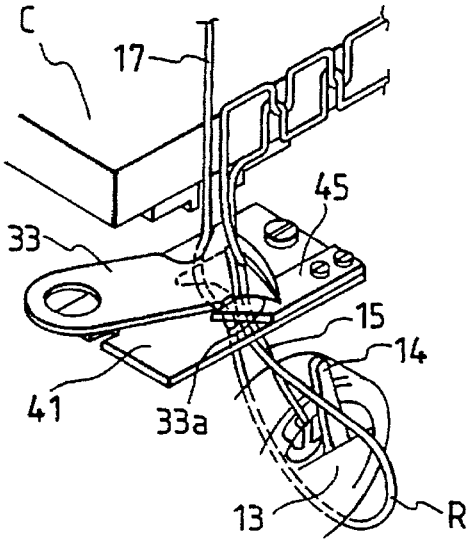

And the movable knife 33 is returned swinging clockwise ("return" swing). FIG. 7F shows how the upper thread and the bobbin thread are caught by the movable knife. More specifically, the bobbin thread 15 and the upper thread 17 (the cloth-side upper thread 17C) are caught by the thread drawing portion **33*a* of the movable knife 33** in the stated order.

Figure 7G:
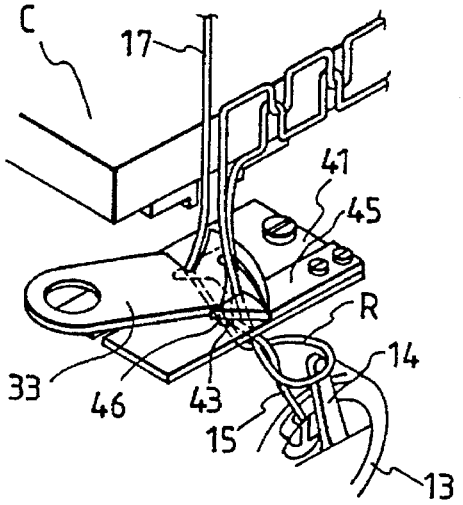

FIG. 7G shows a step in which the bobbin thread is drawn out, and the upper thread is pulled upwardly. The movable knife 33 is further swung clockwise, and the bobbin thread 15 is drawn out of the bobbin casing 13, and the upper thread 17 is pulled upwardly by the thread take-up lever.

Figure 7H:
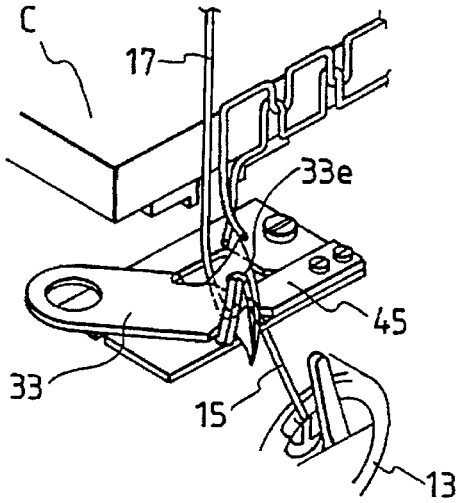

The movable knife 33 is further swung, so that the upper thread 17 (the cloth-side upper thread 17C) and the bobbin thread 15 are cut with the thread cutting edge 33*e* cooperating with the stationary knife 35 as shown in FIG. 7H.

In the thread cutting operation, the bobbin thread 15 which is drawn out being caught by the thread drawing portion 33*a* of the movable knife 33 is moved through the gap between the tapered bobbin thread regulating portion 46 of the bobbin thread holding plate 45 and the upper surface of the shuttle hook race cap 41 and the labyrinth section 49 to the end portion of the bobbin thread lead-in groove, where it is prevented from returning to the thread control hole 42.

Figure 7I:
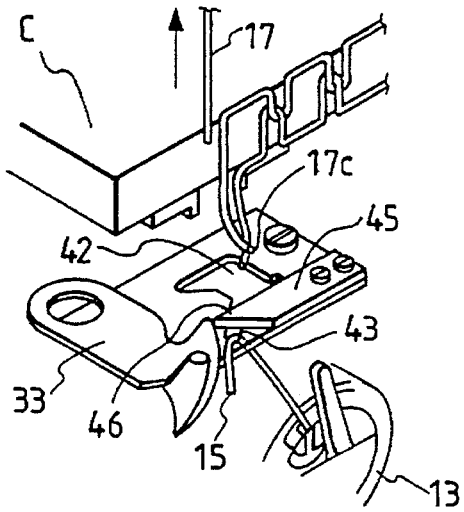

FIG. 7I shows a final step in which the relevant parts are at rest at the end of the thread cutting operation. As shown in FIG. 7I, the end portion of the bobbin thread 15 which has been cut is extended a predetermined length over the shuttle hook race cap 41. That is, it is extended in front of the shuttle hook race ring 11.

In the above-described first embodiment, the labyrinth section 49 may be adjusted according to a thread to be handled; that is, the position of the bobbin thread holding plate 45 on the shuttle hook race cap 41 may be adjusted by use of the fixing screws 48 and 48. More specifically, the bobbin thread holding plate 45 may be moved along the adjusting elongated holes 47 and 47 formed in the shuttle hook race cap 41 until the bobbin thread regulating portion 46 suitably covers the bobbin thread lead-in groove 43, thus providing the labyrinth section 49.

Now, another example of the bobbin thread end holding device, which constitutes a second embodiment of the invention, will be described.

Figure 8:
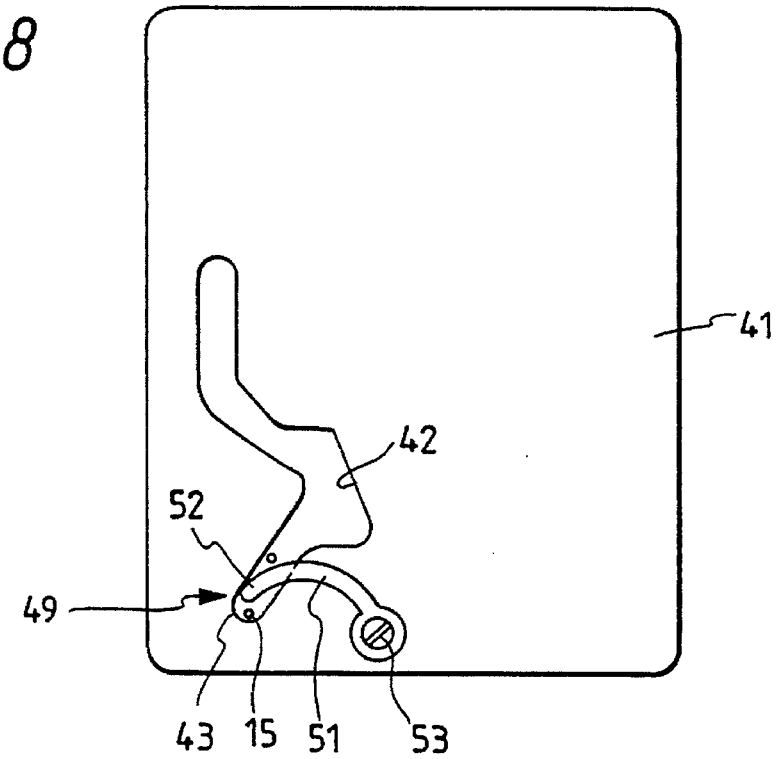
FIG. 8 is a plan view of a shuttle hook race cap in another example of the bobbin thread holding device, which constitutes a second embodiment of the invention.

FIG. 8 shows the second embodiment of the invention. Similarly as in the case of the first embodiment, its shuttle hook race cap 41 has a thread control hole 42 and a bobbin thread lead-in groove 43 which is linearly extended from the latter 42. That is, in the second embodiment, the shuttle hook race cap 41 has the same thread control hole 42 and the same bobbin thread lead-in groove 43 as the one in the first embodiment. However, it should be noted that a bobbin thread holding member 51 which covers the lower-thread lead-in groove 43 except the end portion is different in configuration from the one in the first embodiment.

That is, in the second embodiment, as shown in FIG. 8 the bobbin thread holding member 51 is thin and arcuate, and its left end portion is employed as a bobbin thread regulating portion 52. The right end portion of the bobbin thread holding member 51 is fixedly secured to the shuttle hook race cap 41 with a fixing screw 53. It should be noted that the bobbin thread holding member 51 is curved towards the thread control hole 42.

With the bobbin thread holding member 51 secured to the shuttle hook race cap 41 in the above-described manner, the bobbin thread regulating portion 52 covers the bobbin thread lead-in groove 43 from above except the end portion, thus providing a lap region, and a gap large enough for the bobbin thread 15 to pass is formed between the bobbin thread regulating portion 52 and the upper surface of the shuttle hook race cap 41.

The lap region which is formed by laying the bobbin thread regulating portion 52 over the bobbin thread lead-in groove 43 provides a labyrinth section 49 for the passage of the bobbin thread.

As was described above, the bobbin thread holding member 51 including the bobbin thread regulating portion 52 is curved towards the thread control hole 42, and set on the upper surface of the shuttle hook race cap 41 having the thread control hole 42 and the bobbin thread lead-in groove 43 extended from the latter 43, in such a manner that the bobbin thread regulating portion 52 covers the bobbin thread lead-in groove 43, thus forming the labyrinth section 49. Hence, in cutting the cloth-side upper thread 17C and the bobbin thread 15 with the movable knife 33 cooperating with the stationary knife 35, the bobbin thread 15 entering the bobbin thread lead-in groove 43 from the thread control hole 42 is moved through the gap between the bobbin thread regulating portion 52 of the bobbin thread holding member 51 and the upper surface of the shuttle hook race cap 41 and through the labyrinth section 49 to the end portion of the bobbin thread lead-in groove 43, where the bobbin thread regulating portion 52 prevents the bobbin thread from returning to the thread control hole 42. Thus, the end portion of the bobbin thread 15 which has been cut is held stably.

Hence, similarly as in the first embodiment, in the case where the sewing machine employing the DPS shuttle hook 10 uses the bobbin casing 13 with the engaging member 14 having no thread hole, with the aid of the labyrinth section 49 the bobbin thread regulating portion 46 extending towards the end of the bobbin thread lead-in groove 43 stably holds the end portion of the bobbin thread 15 which has been cut with the thread cutting device 32.

Another example of the bobbin thread end holding device, which constitutes a third embodiment of the invention, will be described with reference to FIG. 9.

Figure 9:
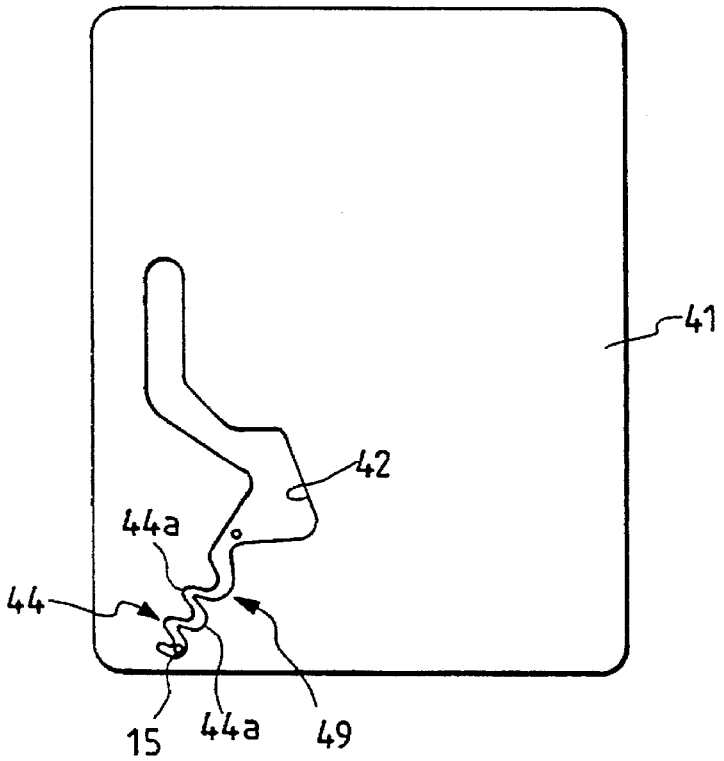
FIG. 9 is a plan view of a shuttle hook race cap in another example of the bobbin thread holding device, which constitutes a third embodiment of the invention.

The third embodiment is similar to the above-described first and second embodiments in that, as shown in FIG. 9, its shuttle hook race cap 41 has a thread control hole 42 and a bobbin thread lead-in groove 44. However, the third embodiment is different from the first and second embodiments in that the bobbin thread lead-in groove 44 is different in configuration from the one in the first or second embodiment, and the third embodiment dispenses with the bobbin thread holding member which covers the bobbin thread lead-in groove from above except the end portion in the first or second embodiment.

That is, in the third embodiment, the bobbin thread lead-in guide 44 extending from the lower left part of the thread control hole 42 of the shuttle hook race cap 41 is in the form of a labyrinth.

More specifically, the bobbin thread lead-in groove 44, unlike those in the first and second embodiments, is not linear; that is, it is in the form of a labyrinth having a plurality of bends 44*a*.

That is, the bobbin thread lead-in groove 44 itself serves as a labyrinth section 49.

As was described above, in the shuttle hook race cap 41, the labyrinth-like bobbin thread lead-in groove 44 extends from the thread control hole 42. Hence, in cutting the cloth-side upper thread 17C and the bobbin thread 15 with the movable knife 33 cooperating with the stationary knife 35, the bobbin thread 15 entering the bobbin thread lead-in groove 44 from the thread control hole 42 is moved through the labyrinth 49 passing through the bends 44*a* arranged in a zigzag, and at or near the end of the bobbin thread lead-in groove 44 the bobbin thread is prevented from returning to the thread control hole 42. Thus, the end portion of the bobbin thread 15 which has been cut is held stably thereat.

Hence, similarly as in the first and second embodiments, even in the case where the sewing machine employing the DPS shuttle hook 10 uses the bobbin casing 13 with the engaging member 14 having no thread hole, with the aid of the right and left bends 44*a* forming the labyrinth section 49 the end portion of the bobbin thread 15 which has been cut with the thread cutting device 32 is positively stably held at or near the end of the bobbin thread lead-in groove 44.

In the above-described embodiments, the engaging member of the bobbin casing for the DPS shuttle hook is short and has no thread hole; however, the invention is not limited thereto or thereby. In the case of an ordinary bobbin casing whose engaging member is long and has a thread hole, the sewing machine may be so designed as not to use the thread hole.

In addition, the prolongation of the thread control hole and the labyrinth section (the bobbin thread lead-in groove, and the bobbin thread holding member) are not always limited to those which have been described above. And other parts also may be suitably modified and changed without departing from the spirit of the invention.

As is apparent from the above description, with the bobbin thread end holding device according to the present invention, the end portion of the bobbin thread can be held at the prolongation of the thread control hole formed in the thread control board. Hence, even in the sewing machine in which the thread hole of the engaging member of the bobbin casing is not used, or in the sewing machine in which the engaging member of the bobbin casing has no thread hole, the end portion of the bobbin thread which has been cut with the thread cutting device can be stabilized.

Hence, the end portion of the cloth-side upper needle is maintained sufficiently long, and the end portion of the bobbin thread is long enough to start the following sewing operation smoothly.

With the bobbin thread end holding device, the labyrinth section positively prevents the end portion of the bobbin thread led into the prolongation of the thread control hole from returning to the latter. Hence, even in the sewing machine in which the thread hole of the engaging member of the bobbin casing is not used, or in the sewing machine in which the engaging member of the bobbin casing has no thread hole, the labyrinth section stabilizes the end portion of the bobbin thread which has been cut with the thread cutting device.

Hence, the end portion of the cloth-side upper needle is maintained sufficiently long, and the end portion of the bobbin thread is long enough to start the following sewing operation smoothly.

In the case of the bobbin thread end holding device according to the first and second embodiments, the labyrinth section is made up of the bobbin thread lead-in groove which is substantially linear, serving as the prolongation, and the bobbin thread holding member which is positioned near the end of the bobbin thread lead-in groove. When the end portion of the bobbin thread is led into the end portion of the bobbin thread lead-in groove through the gap between the bobbin thread lead-in groove and the bobbin thread holding member, the bobbin thread holding member positively prevents the end portion of the bobbin thread from returning to the thread control hole. Hence, even in the sewing machine in which the thread hole of the engaging member of the bobbin casing is not used, or in the sewing machine in which the engaging member of the bobbin casing has no thread hole, the end portion of the bobbin thread which has been cut with the thread cutting device is stabilized by the bobbin thread holding member.

Hence, the end portion of the cloth-side upper needle is maintained sufficiently long, and the end portion of the bobbin thread is long enough to start the following sewing operation smoothly.

In the bobbin thread holding device according to the third embodiment, the labyrinth section is the labyrinth-shaped bobbin thread lead-in groove which has a plurality of bends, serving as the prolongation of the thread control hole. When the end portion of the bobbin thread is led into the labyrinth-shaped bobbin thread lead-in groove passing through the bends, the latter positively prevent it from returning to the thread control hole. Hence, even in the sewing machine in which the thread hole of the engaging member of the bobbin casing is not used, or in the sewing machine in which the engaging member of the bobbin casing has no thread hole, the end portion of the bobbin thread which has been cut with the thread cutting device is positively stabilized by the plurality of bends.

Hence, the end portion of the cloth-side upper needle is maintained sufficiently long, and the end portion of the bobbin thread is long enough to start the following sewing operation smoothly.

What is claimed is:

1. A bobbin thread end holding device and cutter in a sewing machine in which an upper thread and a bobbin thread are used, for holding an end portion of the bobbin thread after being cut, said bobbin thread end holding device and cutter comprising:

cutting means for cutting the upper thread and the bobbin thread; and a bobbin thread control member having an upper surface and a lower surface and including, a thread control hole into which the upper thread and the bobbin thread are led, and a prolongation of said thread control hole extending from said control hole through said thread control member from the upper surface to the lower surface thereof for outwardly introducing the end portion of the bobbin thread cut by said cutting means from said control hole.

2. A bobbin thread end holding device and cutter according to claim 1, wherein said prolongation includes a labyrinth section which prevents the end portion of the bobbin thread led therein from returning to said thread control hole.

3. A bobbin thread end holding device and cutter according to claim 2, wherein said labyrinth section has a labyrinth-shaped bobbin thread lead-in groove which has a plurality of bends forming said prolongation.

4. A bobbin thread end holding device and cutter in a sewing machine in which an upper thread and a bobbin thread are used, for holding an end portion of the bobbin thread after cut, said bobbin thread end holding device and cutter comprising:

cutting means for cutting the upper thread and the bobbin thread; and a bobbin thread control member having an upper surface and a lower surface and including, a thread control hole into which the upper thread and the bobbin thread are led, and a prolongation of said thread control hole extending from said control hole for outwardly introducing the end portion of the bobbin thread cut by said cutting means from said control hole, wherein said prolongation extends from the upper surface to the lower surface of said bobbin thread control member and includes a labyrinth section which prevents the end portion of the bobbin thread led therein from returning to said thread control hole, and wherein the labyrinth section includes:

a bobbin thread lead-in groove which is substantially linear, and a bobbin thread holding member positioned adjacent to an end of said bobbin thread lead-in groove, and having a gap for introduction of the end portion of the bobbin thread, for preventing the end portion of the bobbin thread form returning to said thread control hole.

5. A bobbin thread end holding device and cutter according to claim 4, wherein said bobbin thread holding member is adjustably mounted on said bobbin thread control member.

6. A bobbin thread end holding device and cutter according to claim 4, wherein said bobbin thread holding member has a bobbin thread regulating portion which is tapered and positioned adjacent to said bobbin thread lead-in groove.

7. A bobbin thread end holding device and cutter according to claim 4, wherein said bobbin thread holding member has an arcuate portion adjacent to said bobbin thread lead-in groove.

8. A shuttle hook race cap for a sewing machine using an upper thread and a bobbin thread, said shuttle hook race cap comprising:

a plate having a top surface and a bottom surface with a thread control hole into which the upper thread and the bobbin thread are led; and a prolongation of said thread control hole extending from said control hole and extending from the top surface to the bottom surface of said plate for outwardly introducing the end portion of the bobbin thread from said control hole.

9. A shuttle hook race cap according to claim 8, wherein said prolongation includes a labyrinth section which prevents the end portion of the bobbin thread led therein from returning to said thread control hole.

10. A shuttle hook race cap according to claim 9, wherein said labyrinth section has a labyrinth-shaped bobbin thread lead-in groove which has a plurality of bends forming said prolongation.

11. A shuttle hook race cap for a sewing machine using an upper thread and a bobbin thread, said shuttle hook race cap comprising:

a thread control hole into which the upper thread and the bobbin thread are led; and a prolongation extending from said control hole for outwardly introducing the end portion of the bobbin thread from said control hole;

wherein said prolongation includes a labyrinth section which prevents the end portion of the bobbin thread led therein from returning to said thread control hole, and wherein said labyrinth section includes:

a bobbin thread lead-in groove which is substantially linear, and a bobbin thread holding member positioned adjacent to an end of said bobbin thread lead-in groove, and having a gap for introduction of the end portion of the bobbin thread, for preventing the end portion of the bobbin thread from returning to said thread control hole.

12. A shuttle hook race cap according to claim 11, wherein said bobbin thread holding member is adjustably mounted on said bobbin thread control member.

13. A shuttle hook race cap according to claim 11, wherein said bobbin thread holding member has a bobbin thread regulating portion which is tapered and positioned adjacent to said bobbin thread lead-in groove.

14. A shuttle hook race cap according to claim 11, wherein said bobbin thread holding member has an arcuate portion adjacent to said bobbin thread lead-in groove.

* * * * *